United States Patent [19]

Ichimatsu

[11] 4,296,783

[45] Oct. 27, 1981

Best Available Copy

[54] WEFT YARN END TREATING DEVICE FOR SHUTTLELESS LOOM

[75] Inventor: Eiji Ichimatsu, Koganei, Japan

[73] Assignee: Nissan Motor Company, Ltd., Japan

[21] Appl. No.: 964,716

[22] Filed: Nov. 29, 1978

[30] Foreign Application Priority Data

Dec. 1, 1977 [JP] Japan ..... 52-143308

[51] Int. Cl.[3] ..... D03D 49/70

[52] U.S. Cl. ..... 139/302; 139/194; 139/430

[58] Field of Search ..... 139/194, 195, 302, 303, 139/291 R, 291 C, 292, 294, 429, 430

[56] References Cited

U.S. PATENT DOCUMENTS

| | | | |
|---|---|---|---|
| 2,482,975 | 9/1949 | Gosnell | 139/194 |
| 3,744,533 | 7/1973 | Yano et al. | 139/430 |
| 4,078,586 | 3/1978 | Porter et al. | 139/450 |

FOREIGN PATENT DOCUMENTS

| | | | |
|---|---|---|---|
| 738845 | 2/1970 | Belgium | 139/194 |
| 2407074 | 8/1974 | Fed. Rep. of Germany | 139/302 |
| 45-31273 | 10/1970 | Japan | 139/194 |
| 7704471 | 10/1978 | Netherlands | 139/430 |
| 106527 | 9/1924 | Switzerland | 139/194 |

*Primary Examiner*—Henry Jaudon

*Attorney, Agent, or Firm*—Robert E. Burns; Emmanuel J. Lobato; Bruce L. Adams

[57] ABSTRACT

A weft yarn end treating device for a shuttleless loom comprises a conveyer for conveying the end portion of a weft yarn picked into the shed of warp yarns when the end portion is held to contact with the conveyer, a holder for holding the end portion to contact with the conveyer, and a thrusting member for thrusting the end portion into a location at which the end portion begins to be held to contact with the conveyer, so that any binding yarns for catching and drawing the end portion of the picked weft yarn out of the shuttleless loom can be omitted to solve the problems raised in prior art.

34 Claims, 8 Drawing Figures

WEFT YARN END TREATING DEVICE FOR SHUTTLELESS LOOM

BACKGROUND OF THE INVENTION

This invention relates in general to a shuttleless loom of fluid jet type and more particularly to a device for treating the end portions of weft yarns picked into the shed of warp yarns.

A shuttleless loom of fluid jet type is usually equipped with a weft yarn end treating device which has been disclosed, for example, in U.S. Pat. No. 3,297,057 to Yukio Mizuno et al, entitled "Device for Grasping and Guiding Travelling End of Wefts", in which a plurality of binding yarns are stretched adjacent and parallelly with the arrays of warp yarns. These binding yarns are arranged to separate or close to each other with the opening (shedding) operation or the closing operation of the array of warp yarns. The binding yarns securely catches the end portion of weft yarn which has been picked into the shed of the wrap yarns. The binding yarns which have caught the weft yarn end portion then passes through a guide member which is disposed adjacent the weave front of a woven fabric. Thereafter, the binding yarns are rotated to be twisted by a twisting device and consequently the caught end portion is pulled in tension.

In this weft yarn end treating device, the tensioned end portion of the picked weft yarn is in generally cut by a cutter after several picks of the weft yarns have been completed. The thus cut end portion is thereafter conveyed out of the shuttleless loom being involved in the twisted binding yarns.

However, such the weft yarn end treating device of the shuttleless loom has encountered the following problems. The cut end portions caught by the binding yarns are flourished by the twisting action of the binding yarns. The flourished cut end portions are liable to twine around the other portions of the binding yarns. Accordingly, if the cut end portions of the weft yarns twine around the other portion of the binding yarns bridging a projecting member of the shuttleless loom, such as the above-mentioned guide member, the binding yarns cannot run or move though being continued to be pulled at a certain speed, and accordingly the binding yarns are cut in case that the weft yarn is considerably strong as compared with the binding yarns.

Furthermore, whenever the binding yarns have been cut, the shuttleless loom is required to stop to connect the cut binding yarns. This stop of the stuttleless loom causes undesirable markings on the surface of the woven fabric (product). Moreover, in such a weft yarn end treating device, at least three binding yarns are necessary to securely binding the weft yarn ends and additionally the binding yarns are being pulled to move at a speed of about several times the moving speed of the warp yarns. Therefore, considerably large amounts of the binding yarns are unavoidably consumed, accompanying poor economy.

SUMMARY OF THE INVENTION

It is the prime object of the present invention to provide, in a shuttleless loom of fluid jet ype, an improved weft yarn end treating device which can solve the problems encountered in prior art, without using any binding yarns for catching and binding the end portions of weft yarns picked into the shed of warp yarns.

Another object of the present invention is to provide, in a shuttleless loom of fluid jet type, an improved weft yarn end treating device by which the end portion of a weft yarn picked into the shed of warp yarns can be mechanically and automatically conveyed out of the suttleless loom after being cut by a cutter.

A further object of the present invention is to provide, in a shuttleless loom of fluid jet type, an improved weft yarn end treating device by which the end portion of a weft yarn picked into the shed of warp yarns is first thrusted or put into a location at which the end portion is caught by conveying means, and thereafter the end portion is conveyed apart the weave front of a woven fabric in cooperation with holding means for holding the end portion to be caught by the conveying means.

A still further object of the present invention is to provide, a shuttleless loom of fluid jet type, an improved weft yarn end treating device, in which firstly the end portion of a weft yarn picked into the shed of warp yarns is caught by a catching device, secondly the caught end portion is thrusted to contact with a conveyer disposed along the side of a woven fabric, thirdly the end portion is conveyed by the conveyer along the side of the woven fabric, and lastly conveyed end portion is carried out of the shuttleless loom after cut by a cutter.

Other objects, features and advantages of improved weft yarn end treating device according to the present invention will become more apparent from the following description taken in conjunction with the accompanying drawings in which like reference numerals and characters are assigned to the corresponding parts and elements throughout various embodiments.

DESCRIPTION OF THE PREFERRED EMBODIMENTS

Figure 1:
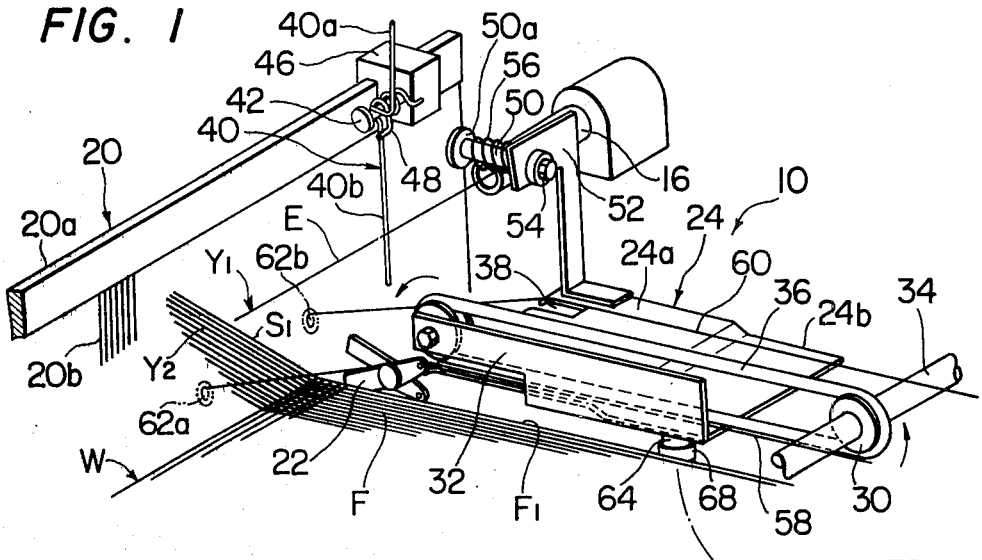
FIG. 1 is a perpsective view of essential parts of a shuttleless loom including a preferred embodiment of a weft yarn end treating device in accordance with the present invention.

Referring now to FIGS. 1 to 4, there is illustrated essential parts of a shuttleless loom of fluid jet type, including a weft yarn end treating device 10 in accordance with the present invention. The shuttleless loom is composed of a frame 12 in which various moving parts are mounted. The reference character $Y_1$ indicates a weft yarn which is projected with a fluid under pressure from a nozzle 14 forming part of a weft yarn projecting unit which is mounted on the frame 12. The weft yarn $Y_1$ is picked into the shed of warp yarns $Y_2$ and then the leading end of the weft yarn $Y_1$ is sucked into a sucking device 16 mounted on the frame 12. The sucking device 16 comprises a cylindrical tube (no numeral) which is fluidly connected to a suction vacuum source (not numeral). Accordingly, an end portion E of the picked weft yarn $Y_1$ projecting from a side $S_1$ of the warp yarn array, is maintained in tension as shown in FIG. 1. The side $S_1$ is opposite to the other side $S_2$ of the array of the warp yarns $Y_2$ the side $S_2$ being adjacent the nozzle 14. Accordingly, the side $S_1$ is remote away from the nozzle 14. A woven fabric F is passed on spacedly and parallelly located two rollers (not shown) to be stretched between the two rollers. A reed 20 is movably supported by the frame 12, which reed functions to beat up the picked weft yarn $Y_1$ against the weave front W or so-called closs fell of the woven fabric F.

A cutter 22 of the form of scissors is disposed adjacent a side $F_1$ of the fabric F which side corresponds to the side $S_1$ of the array of the warp yarns $Y_2$. The cutter 22 functions to cut the projected end portion E of the picked weft yarn $Y_1$ in close proximity to the side $F_1$ of the fabric F.

Figure 3:
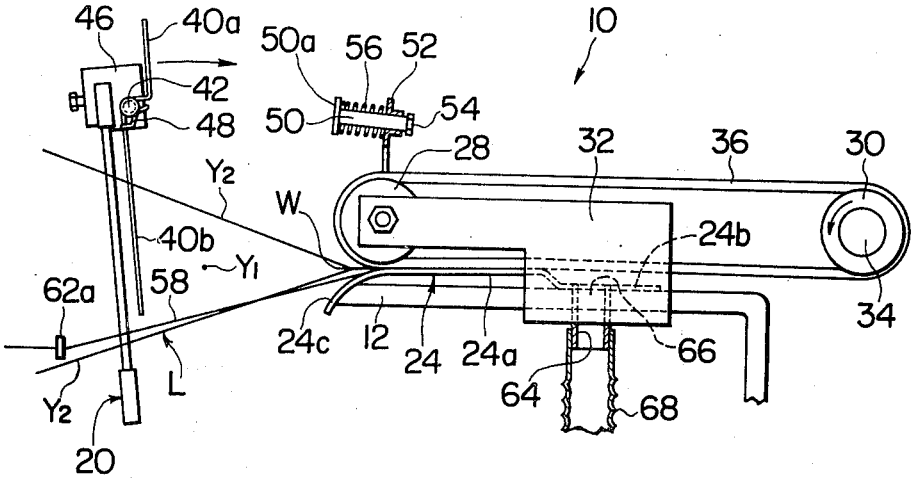
FIG. 3 is a side elevation of the weft yarn end treating device of FIG. 1, showing a state of the treating device.

A resilient plate member 24 is disposed generally parallelly with respect to and elongates along the fabric side $F_1$. The resilient plate member 24 forms part of the weft yarn end treating device 10 which is arranged and constructed to automatically treat the projected end portion E of the picked weft yarn $Y_1$. The plate member 24 is made of a spring material such as a spring steel and formed with a higher portion **24*a* and a lower portion 24*b*. The higher portion 24*a* is adjacent the weave front W and the lower portion 24*b* is remote from the weave front W. The higher portion 24*a* lies generally in the same level as the fabric F and accordingly the lower portion 24*b* lies below the level of the fabic F. The plate member 24 is further formed with a bent portion 24*c* which is contactable with a projected portion (no numeral) of the frame 12 as shown in FIG. 3. The plate member 24 is secured at its lower portion on the frame 12 with a small screw 26 so that the plate member 24** is maintained in the state of a cantilever.

Two pulleys 28 and 30 are spacedly disposed adjacent the plate member 24 so that the axes of the pulleys are arranged parallel with the weave front W of the fabric F. The pulley 28 is rotatably supported on a bracket 32 secured to the frame 12. The other pulley 30 is fixedly mounted around a rotatable shaft 34 which is rotated in accordance with the operation of the shuttleless loom. A loop-shaped belt 36 is passed on the two pulleys 28 and 30 to be stretched between the two pulleys. The lower surface of the belt 36 is contacted with the surface of the higher portion **24*a*. Accordingly, when the pulley 30 is rotated in a direction of an arrow indicated in FIG. 1, the belt 36 slidably moves on the surface of higher portion 24*a* of the plate member 24 in a direction generally parallel with the side $F_1$ of the woven fabric F. The belt 36 is arranged to move at a certain speed of about six times the moving speed of the woven fabric F in consideration of sliding caused between the surface of the belt 36 and the end portion E of the weft yarn to be contacted with the belt 36. The plate member 24 is formed at its bent portion 24*c* with a cut-out portion 38** which elongates parallelly with the side $F_1$ of the fabric F.

A thrust rod member 40 is rotatably mounted at its central portion on a pin 42 having a head portion (no numeral). The pin 42 is securely inserted into a support member 46 which is fixed to the frame **20*a* of the reed 20. The rod member 40 is biased clockwise by means of a torsion spring 48, but is normally kept parallel with a dent 20*b* or a comb-like portion of the reed 20 by the action of a stopper (not shown) for restricing the clockwise movement of the rod member 40. The reference numeral 50 represents a push rod having a head portion 50*a* which is arranged to strike and push the upper portion 40*a* of the thrust rod member 40 counterclockwise when the thrust rod member 40 is advanced in the direction of an arrow shown in FIG. 3 with the advancing movement of the reed 20 to beat up the picked weft yarn against the weave front W of the woven fabric F. The push rod 50 is slidably disposed through a bracket 52 secured to the plate member 24. The push rod 50 is further provided with a nut 54 on its one end which is opposite to the other end at which the head portion 50*a* is formed. As shown, a compression spring 56 is disposed around the push rod 50 and between the head portion 50*a* and the bracket 52 to normally bias the push rod 50 in the direction that the nut 54 contacts the bracket 52**.

Two guide threads 58 and 60 are stretched generally parallelly with a lower array L (shown in FIG. 3) of the warp yarns by means of thread guides **62*a* and 62*b*. The two guide threads 58 and 60 slidably contact with flat surface of the higher portion 24*a* of the plate member 24 from the bent portion 24*c* of the plate member 24, and elongate in the direction generaly parallel with the side $F_1$ of the woven fabric F. The guide thread 58 is located closer to the side $F_1$ of the fabric F than the pulley 28, while the guide thread 60 is located further from the fabric side $F_1$ than the cut-out portion 38. These guide threads 58 and 60 are replaceable with a stationary guide member (not shown) of a rigid structural member, in which the corresponding portion at the dent 20*b* of the reed 20** is removed.

Figure 4:
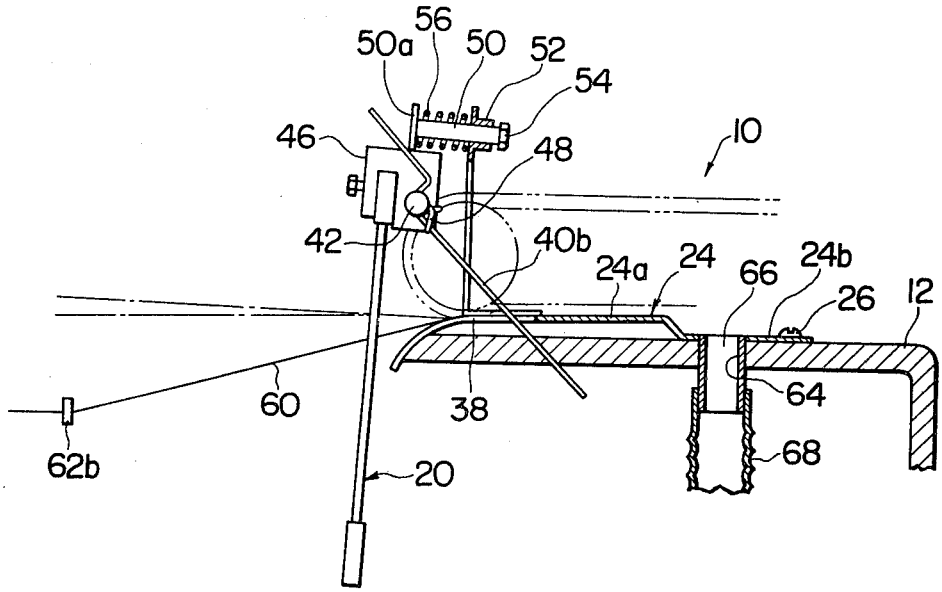
FIG. 4 is a side elevation, partly in section, of the weft yarn treating device of FIG. 1, showing another state of the treating device.

The plate member 24 is formed at its lower portion **24*b* with an opening (no numeral) which meets an opening (no numeral) formed through the wall of the frame 12 as viewed in FIG. 4. A pipe 64 is securely disposed bridging the openings of the lower portion 24*b* and the frame 12, defining a suction opening 66 therein. The pipe 64 is fluidly connected through a flexible tube 68 to a filter 70*a* which is disposed at the suction side of a blower 70**.

The operation of the weft yarn end treating device 10 of the present invention as illustrated in FIGS. 1 to 4 will be now explained. After picking operation of the weft yarn $Y_1$ is completed, and the leading end of the yarn $Y_1$ is caught by the sucking device 16, the reed 20 begins to operate to beat up or batten the picked weft yarn $Y_1$ against the weave front W. During this beating or battening operation of the reed 20, the upper portion **40*a* of the thurst rod member 40 strikes against the head portion 50*a* of the push rod 50 to rotate the thrust rod member 40 unticlockwise around the pin 42. Then, the lower portion 40*b* moves to enter the cut-out portion 38, pushing the end portion E of the picked weft yarn $Y_1$ in the state of FIG. 4 on and along the guide threads 58 and 60**.

Figure 2:
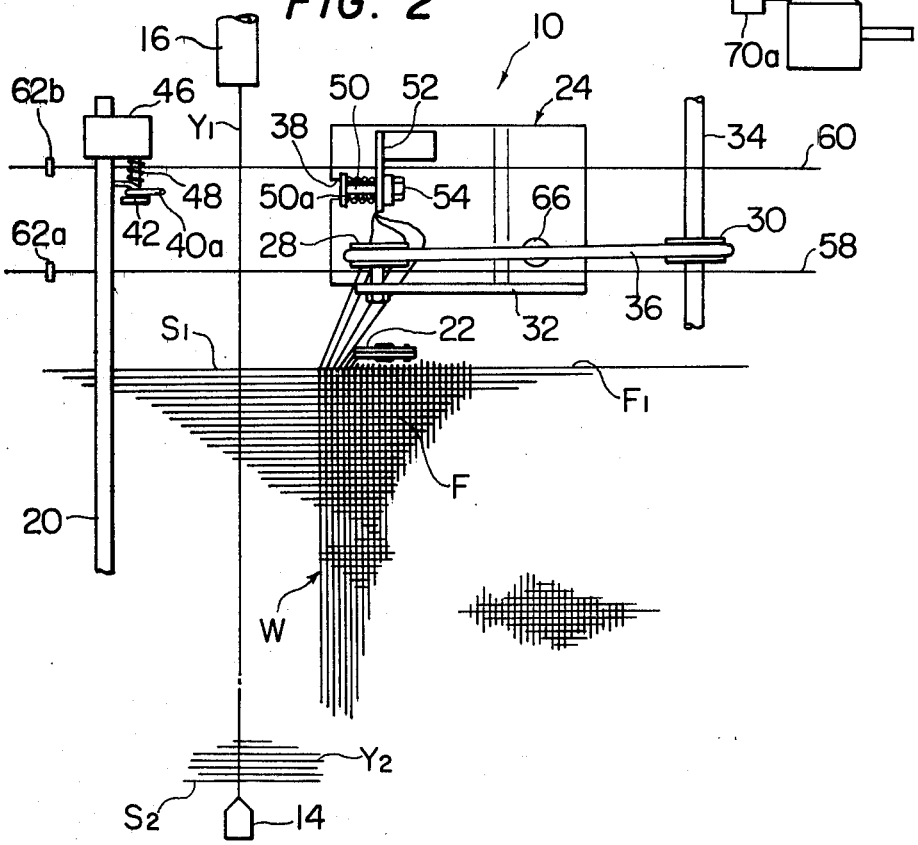
FIG. 2 is a plan view of the shuttleless loom of FIG. 1.

As a result, the pushed end portion E of the weft yarn $Y_1$ is thrusted between the belt 36 and the higher portion **24*a* of plate member 24. The end portion E of the weft yarn $Y_1$ is then carried by the moving belt 36** which is moved by the driven pulley 30, being urged to contact with the surface of the belt by the action of the higher portion 24*a* of the plate member 24. At this moment, the end portion E of the picked weft yarn $Y_1$ is forced to move at a speed of more than three times the moving speed of the woven fabric F, and therefore the end portion of the weft yarn $Y_1$ is held in tension to prevent the end portion E from slacking. The end portion E of the weft yarn $Y_1$ is cut by a cutter 22 as illustrated in FIG. 2 after several picks of the weft yarns $Y_1$ are completed. The cut end portion E is further conveyed sliding on the higher portion 24*a*, and released when conveyed beyond the higher portion 24*a*. Then, the cut end portion E drops on the surface of the lower portion 24*b* of the plate member 24 to be sucked into the suction opening 66 by the action of vacuum generated in the pipe 64. It is to be noted that the sucked end portion E is lastly caught by the filter 70*a*.

While the picked weft yarn sucking device 16 has been shown and described only to suck the end portion E of the picked weft yarn $Y_1$, it will be understood that the sucking device 16 may be constructed and arranged to suck also water when the shuttleless loom is of a water jet type wherein the picking of the weft yarn $Y_1$ is accomplished by the action of water jet. In such a case, the sucking of the sucking device 16 may begin when the picking of the weft yarn $Y_1$ has just been finished. Moreover, it will be appreciated that the sucking device 16 is replaceable with any other devices for catch the end portion of a weft yarn picked into the shed of warp yarns.

Figure 5:
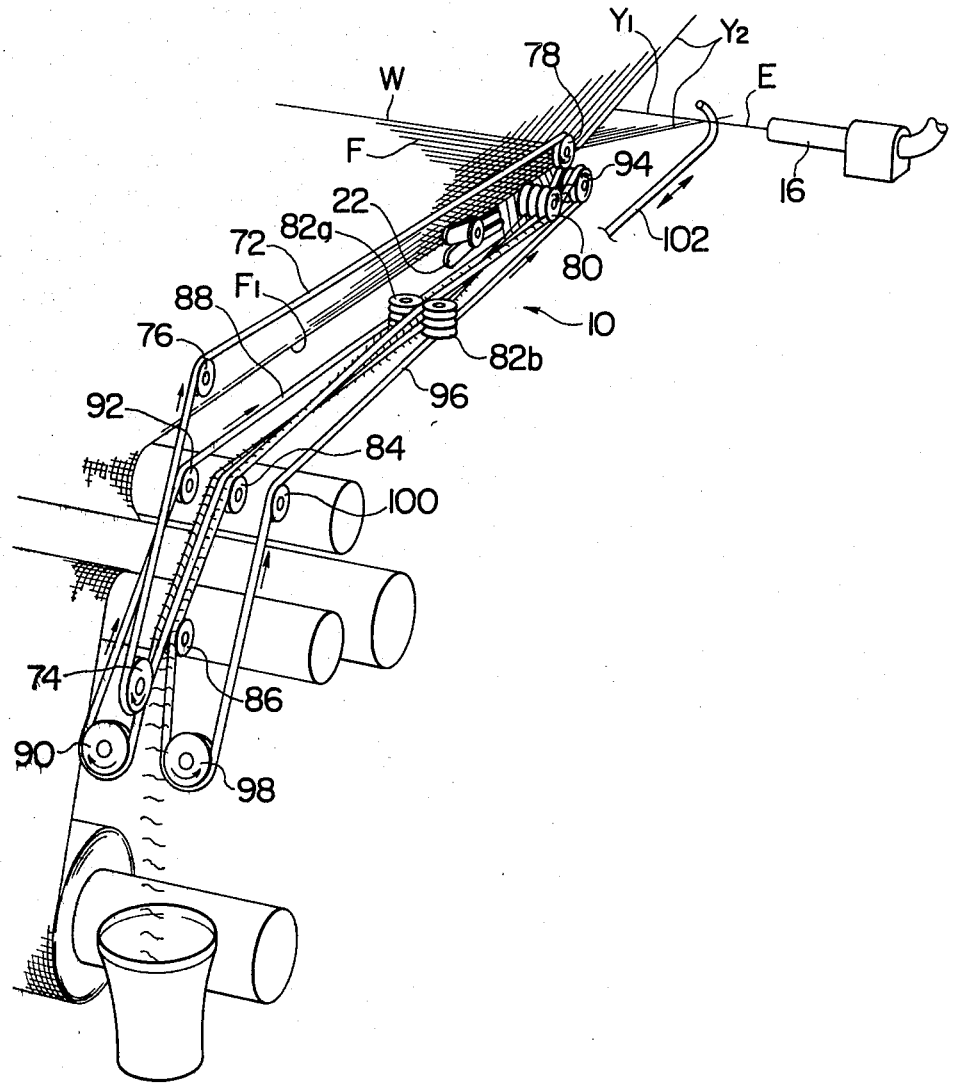
FIG. 5 is a perspective view of essential parts of a shuttleless loom including another preferred embodiment of a weft yarn end treating device in accordance with the present invention.
Figure 6:
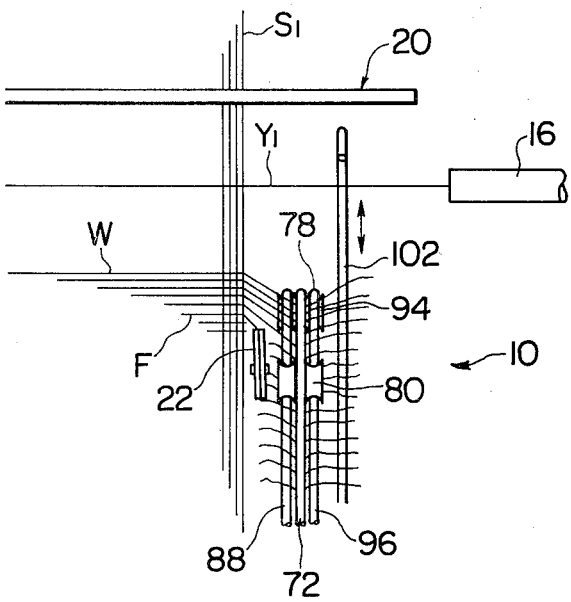
FIG. 6 is a plan view showing the weft yarn end treating device of FIG. 5.

FIGS. 5 and 6 illustrate another preferred embodiment of a weft yarn end treating device 10 according to the present invention. The weft yarn end treating device 10 of this instance comprises an upper loop-shaped belt 72 which is passed on pulleys 74, 76, 78 and pulleys (each having three gooves for receiving belts) 80, 82*a*, 82*b*, 84 and 86. As shown, the upper belt 72 is passed on the central grooves of the pulleys 80, 82*a*, 82*b*, 84 and 86. A first lower loop-shaped belt 88 is passed on pulleys 90, 92, a pulley 94 (having three grooves for receiving belts), and the pulleys 80, 82*a*, 82*b*, 84 and 86. The first lower belt 88 is passed on one of two side grooves formed on each of the pulleys 94, 80, 82*a*, 82*b*, 84 and 86. Similarly, a second lower loop-shaped belt 96 is passed on pulleys 98, 100, the pulleys 94, 80, 82*a*, 82*b*, 84 and 86. As seen, the second lower belt 96 is passed on one of two side grooves of each of the pulleys 94, 80, 82*a*, 82*b*, 84 and 86. The side groove on which the first lower belt 88 is passed is opposite to the side groove on which the second lower belt 96 is passed, with respect to the central groove. It will be seen that all the belts 72, 88 and 96 run together in the substantially same direction as the moving direction of the woven fabric F within the region from the pulley 80 to the pulley 86. However, the belts 72, 88 and 96 turn back in the direction opposite to the moving direction of the woven fabric F by means of the pulleys 74, 90 and 98, respectively.

The reference numeral 102 indicates a hook member which reciprocally move in the directions of a twohead arrow in accordance with the weaving operation of the shuttleless loom. In this instance, the hook member 102 is constructed and arranged to first hitch the end portion E of the picked weft yarn $Y_1$ caught by the sucking device 16, and then to thrust or put it between the upper belt 72 and the two lower belts 88 and 96, passing through a space between the pulleys 78 and 94. It is to be noted that the three belts 72, 88 and 96 are arranged to move at a speed slightly higher than the moving speed of the woven fabric F.

With the thus arranged weft yarn end treating device 10, when the end portion E of the weft yarn $Y_1$ is caught by the sucking device 16 after picking operation of the weft yarn $Y_1$, the hook member 102 hitches the end portion E to bring and thrust it between the upper belt 72 and the lower two belts 88 and 96 immediately before the beating operation of the reed (not shown). Then, the end portion E is pulled in the direction same as the moving direction of the woven fabric F being kept between the upper belt 72 and the lower belts 88 and 96. It is to be noted that the end portion E is pulled to move at a speed higher than the moving speed of the woven fabric F and therefore kept in tension. The pulled end portion E is cut by the cutter 22 when several picks of the weft yarns are completed after the end portion E is inserted between the upper belt 72 and the lower belts 88 and 96. The cut end portion E or a waste yarn is conveyed by the cooperation of the upper belt 72 and the lower belts 88 and 96, successively passing through the pulleys 80, 82*a*, 82*b*, 84 and 86, and then released when the waste yarn is conveyed beyond the pulley 86 to drop into a container (no numeral) for accumulating the waste yarns therein.

Figure 8:
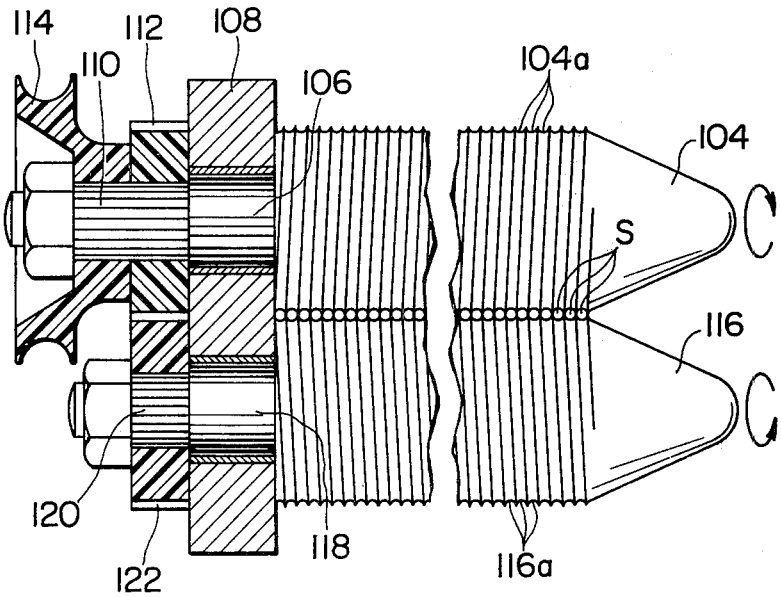
FIG. 8 is a side elevation, partly in section, of a main part of the weft yarn end treating device of FIG. 7.
Figure 7:
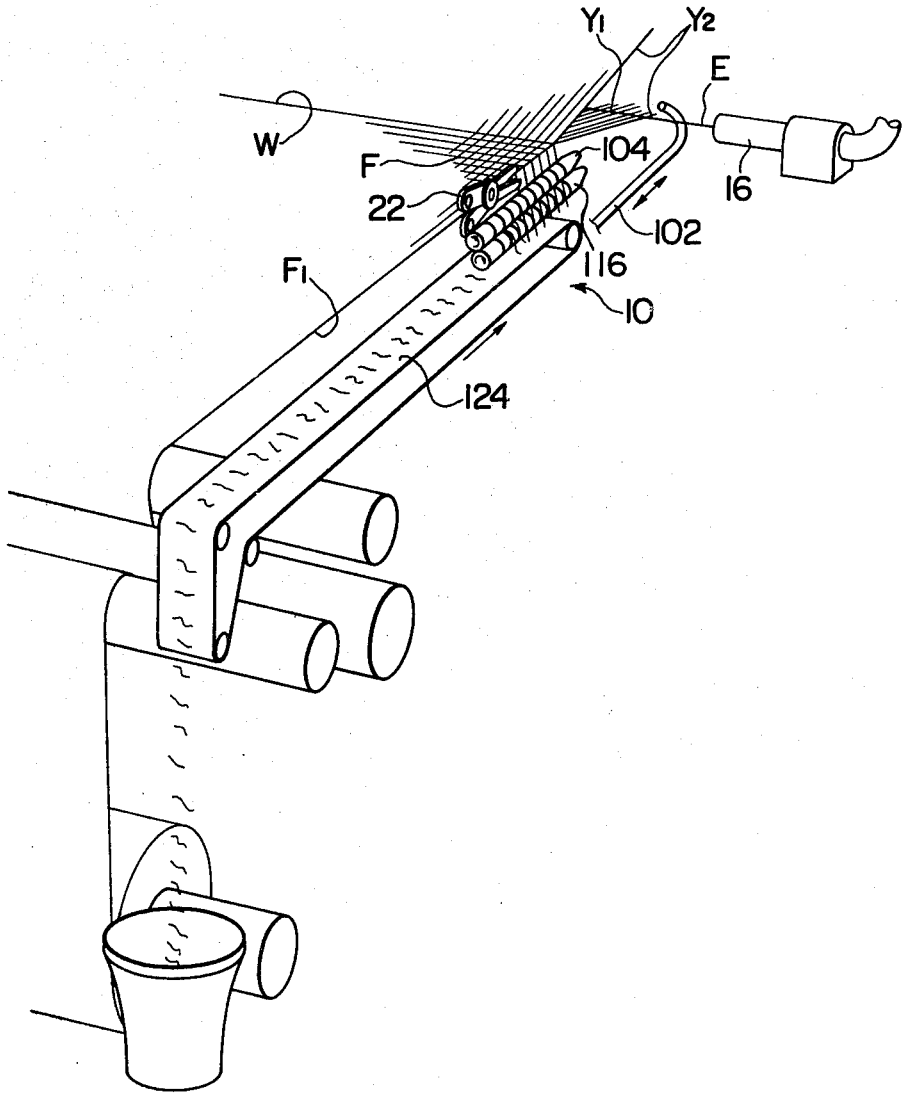
FIG. 7 is a schematic perpsective view of essential parts of a shuttleless loom including a further preferred embodiment of a weft yarn end treating device in accordance with the present invention.

FIGS. 7 and 8 illustrate a further preferred embodiment of a weft yarn end treating device 10 in accordance with the present invention. The weft yarn end treating device 10 of this instance comprises an upper cylindical roller 104 which is formed at its cylindrical surface with a continuous spiral groove 104*a* which is formed substantially the same as that of a so-called left hand screw. The upper roller 104 is integrally formed at its one end with a smooth cylindrical portion 106 which is rotatably supported by a support bracket 108. A cylindrical toothed portion 110 is formed integrally with the cylindrical portion 106. Securely mounted on the toothed portion 110 are a gear 112 and a drive pulley 114 through which the upper roller 104 is rotated in accordance with the weaving operation of the shuttleless loom.

A lower cylindrical roller 116 is disposed in close proximity to the upper cylindrical roller 104, and formed at its cylindrical surface with a continuous spiral groove 116*a* which is formed substantially the same as that of a so-called right hand screw. It is to be noted that the spiral groove 116*a* of the lower cylindrical roller 116 is located opposite to the spiral groove 104*a* of the upper cylindrical roller 104, defining therebetween a plurality of generally circular (in section) spaces S as clearly shown in FIG. 8. The lower cylindrical roller 116 is formed with a smooth cylindrical portion 118 which is rotatably supported by the support bracket 108. The smooth cylindrical portion 118 is provided with a cylindrical toothed portion 120 on which a gear 122 is mounted to be meshed with the gear 112. It will be understood that the cylindrical rollers 104 and 116 are rotated at the same rotational speed and in opposite directions to each other as indicated by arrows shown in FIG. 8. It is to be noted that the tip of each of the cylindrical rollers 104 and 116 is formed generally into a cone-shape in order that the end portion E of the picked weft yarn $Y_1$ is easily thrusted between the upper and lower cylindrical rollers 104 and 116.

In this instance, the hook member 102 is arranged to first hitch the end portion E of the picked weft yarn $Y_1$ and thereafter thrust or put it between the upper and lower cylindrical rollers 104 and 116, moving in the directions indicated by the two-head arrow in FIG. 7. A loop-shaped conveyor 124 is provided adjacent and along the side $F_1$ of the woven fabric F. The belt conveyor 124 is moved in the direction same as the moving direction of the woven fabric F.

With the thus arranged weft yarn end treating device 10, the end portion E of the picked weft yarn $Y_1$ is hitched by the hook member 102 immediately before the beating operation of the reed (not shown), and then thrusted or put into the first formed circular space defined between the grooves of the upper and lower cylindrical rollers 104 and 116. Thereafter, the end portion E is carried or conveyed toward the support bracket 108 with the rotations of the upper and lower rollers 104 and 116, being movably kept in the succeeding spaces S formed between the cylindrical surface of the upper and lower rollers 104 and 116. At this moment, the end portion E of the picked weft yarn $Y_1$ is pulled to be held in its tensioned state. The pulled end portion E is cut by the cutter 22 when several picks of the weft yarns $Y_1$ are completed after the end portion E is inserted into the first formed space S. Meanwhile, the cut end portion E or a waste yarn gets out the grooves 104*a* and 116*a* of the upper and lower cylindrical rollers 104 and 116. Thereafter, the waste yarn drops onto the surface of the belt conveyor 124 and conveyed in the direction same as the moving direction of the woven fabric F to be collected in a container (no numeral).

What is claimed is:

1. In a shuttleless loom having yarn inserting means located adjacent a first side of the array of warp yarns from which inserting means a weft yarn is picked into the shed of the warp yarns to weave a fabric, a weft yarn end treating device for treating an end portion of the picked weft yarn which end portion is projected from a second side of the array of the warp yarns, the second side being opposite to the first side and remote away from the yarn inserting means, said weft yarn end treating device comprising:

conveying means for conveying the projected end portion of the weft yarn in a direction generally the same as the moving direction of woven fabric from a portion adjacent the weave front of a woven fabric, when the projected end portion is held to contact therewith;

holding means for holding the projected end portion to contact with said conveying means;

thrusting means for thrusting the projected end portion of the weft yarn into a location at which the projected end portion begins to be held to contact with the conveying means, said thrusting means being actuated in connection with the operation of said loom, said thrusting means including a movable rod member swingably supported on the frame of a reed of said shuttleless loom, said movable rod member including upper and lower portions which extend generally oppositely with respect to a portion at which said movable rod member is swingably supported, and a push rod member disposed stationary relative to the frame of said shuttleless loom, said push rod member being strikable against the upper portion of said movable rod member to move the lower portion of said movable rod member so as to carry the projected end portion of the weft yarn into said location; and cutting means for cutting the projected end portion of the weft yarn in close proximity to a side of the fabric corresponding to the second side of the warp yarn array, after the projected end portion is thrust into said location, said cutting means being located between the fabric and said conveying means.

2. A weft yarn end treating device as claimed in claim 1, in which said conveying means includes a belt movable in the direction substantially the same as the moving direction of the woven fabric, said belt being disposed further from said side of the fabric than said cutting means.

3. A weft yarn end treating device as claimed in claim 2, in which said holding means includes a stationary plate member contactable with the surface of said belt, said stationary plate member being secured to the frame of said shuttleless loom.

4. A weft yarn end treating device as claimed in claim 3, in which said belt is of a loop-shaped.

5. A weft yarn end treating device as claimed in claim 4, in which said conveying means includes first and second pulleys which are located separate from each other, said first pulley being located adjacent said cutting means, said belt being passed on said two pulleys.

6. A weft yarn end treating device as claimed in claim 5, in which said stationary plate member includes a higher portion to which the surface of the belt is contactable, and a lower portion which is depressed below said higher portion and from which the surface of said belt is spaced apart.

7. A weft yarn end treating device as claimed in claim 6, in which said higher portion is formed with a bent end portion which is located adjacent said first pulley and elongates parallelly with the weave front of said fabric.

8. A weft yarn end treating device as claimed in claim 6, in which said movable rod member is rotatably supported on a pin fixed to a support member secured to the frame of said reed, said pin being arranged parallel with the weave front of said fabric, said movable rod member being separated into upper and lower portions at its portion through which said movable rod member is supported on said pin.

9. A weft yarn end treating device as claimed in claim 8, in which said thrusting means further comprises a push rod member which is movably secured to a bracket fixed to said high portion of said stationary plate member, said push rod member pushing the upper portion of said movable rod member counterclockwise to move the lower portion counterclockwise when the upper portion of said movable rod member strikes against the push rod member during the beating operation of said reed, the counterclockwise movement of the lower portion causing the projected end portion of the weft yarn to enter said location at which the projected end portion begins to be held to contact with the surface of said belt.

10. A weft yarn end treating device as claimed in claim 9, said upper portion of said stationary plate member is formed with a cut-out portion which extends from said bent portion and parallelly with said side of said fabric, said lower portion of said movable rod member being enterable into said cut-out portion when moved counterclockwise.

11. A weft yarn end treating device as claimed in claim 10, further comprising guide means for guiding the projected end portion of the weft yarn into said location when the end portion is thrusted by said thrusting means, said guide means including first and second guide threads which are disposed parallelly with said side of said fabric contacting with the surface of the higher portion of said stationary plate member, said first guide thread being located between said belt and said cutting means, and said second guide thread being located between said cut out portion and said bracket to which said push rod member is movably secured, the projected end portion of the weft yarn being slidably guided on said first and second guide threads toward said location at which the projected end portion of the weft yarn begins to be held to contact with said belt.

12. A weft yarn end treating device as claimed in claim 6, further comprising collecting means for collecting the projected end portion after cut by said cutting means, said collecting means including a pipe member opening to the surface of the lower portion of said stationary plate member, said pipe member being fluidly connected to the suction side of a blower.

13. A weft yarn end treating device as claimed in claim 6, in which said first pulley is rotatably supported by a bracket secured to said stationary plate member and said second pulley is fixedly mounted on a drive shaft which is rotatable in accordance with the operation of said shuttleless loom.

14. A weft yarn end treating device as claimed in claim 3, further comprising cathing means for detachably catching the end portion of the picked weft yarn adjacent the second side of the warp yarn array, maintaining the end portion of the picked weft yarn in its tensioned state.

15. A weft yarn end treating device as claimed in claim 14, in which said catching means includes sucking means for sucking therein the end portion of the picked weft yarn by the action of suction vacuum.

16. A weft yarn end treating device as claimed in claim 15, in which said sucking means includes a cylindrical tube disposed adjacent the second side of the warp yarn array and having its axis which is arranged parallelly with the weave front of the woven fabric, said cylindrical tube being fluidly connected to a suction vacuum source to generate therein a suction vacuum.

17. In a shuttleless loom having yarn inserting means located adjacent a first side of the array of warp yarns from which inserting means a weft yarn is picked into the shed of the warp yarns to weave a fabric, a weft yarn end treating device for treating an end portion of the picked weft yarn which end portion is projected from a second side of the array of the warp yarns, the second side being opposite to the first side and remote away from the yarn inserting means, said weft yarn end treating device comprising:

conveying means for conveying the projected end portion of the weft yarn in a direction generally the same as the moving direction of woven fabric from a portion adjacent the weave front of a woven fabric, when the projected end portion is held to contact therewith, said conveying means including first belt means which is movable substantially in the same direction as the moving direction of the woven fabric;

holding means for holding the projected end portion to contact with said conveying means, said holding means including second belt means movable disposed adjacent and along said first belt means, and associating means for associating said second belt means with said first belt means to hold the projected end portion of the weft yarn to contact with said first belt means by the action of said second belt means, thrusting means for thrusting the projected end portion of the weft yarn into a location at which the projected end portion begins to be held to contact with the conveying means, said thrusting means being actuated in connection with the operation of said loom; and cutting means for cutting the projected end portion of the weft yarn in close proximity to a side of the fabric which side corresponds to the second side of the warp yarn array, after the projected end portion is thrust into said location, said cutting means being located between the fabric and said conveying means.

18. A weft yarn end treating device as claimed in claim 17, in which said thrusting means includes a hook member for pulling the projected end portion of the weft yarn into said location at which the projected end portion begins to be held to contact with said first belt means.

19. A weft yarn end treating device as claimed in claim 18, in which said first belt means includes a first loop-shaped belt which is passed on a plurality of pulleys.

20. A weft yarn end treating device as claimed in claim 19, in which said second belt means includes second and third loop-shaped belts each of which is passed on a plurality of pulleys, and said associating means includes at least one of a pulley having adjacent three grooves on which said first, second and third loop-shaped belts are passed, respectively, in which said first loop-shaped belt is passed on the centrally located groove of the three grooves.

21. A weft yarn end treating device as claimed in claim 18, in which further comprising catching means for detachably catching the end portion of the picked weft yarn adjacent the second side of the warp yarn array, maintaining the end portion of the picked weft yarn in its tensioned state.

22. A weft yarn end treating device as claimed in claim 21, in which said catching means includes sucking means for sucking therein the end portion of the picked weft yarn by the action of suction vacuum.

23. A weft yarn end treating device as claimed in claim 22, in which said sucking means includes a cylindrical tube disposed adjacent the second side of the warp yarn array and having its axis which is arranged parallelly with the weave front of the woven fabric, said cylindrical tube being fluidly connected to a suction vacuum source to generate therein a suction vacuum.

24. In a shuttleless loom having yarn inserting means located adjacent a first side of the array of warp yarns from which inserting means a weft yarn is picked into the shed of the wrap yarns to weave a fabric, a weft yarn end treating device for treating an end portion of the picked weft yarn which end portion is projected from a second side of the array of the warp yarns, the second side being opposite to the first side and remote away from the yarn inserting means, said weft yarn end treating device comprising:

conveying means for conveying the projected end portion of the weft yarn in a direction generally the same as the moving direction of woven fabric from a portion adjacent the weave front of a woven fabric, when the projected end portion is held to contact therewith, said conveying means including a first rotatable cylindrical roller which is formed at its cylindrical surface with a first continuous spiral groove;

holding means for holding the projected end portion to contact with said conveying means, said holding means including a second rotatable cylindrical roller which is formed at its cylindrical surface with a second continuous spiral groove, said second roller being disposed in close proximity to said first roller, the second spiral groove of said second roller being located opposite to the first spiral groove of said first roller to form a plurality of spaces therebetween, the projected end portion of the weft yarn being disposed in each space, said spaces being aligned along the longitudinal axes of said roller;

thrusting means for thrusting the projected end portion of the weft yarn into a location at which the projected end portion begins to be held to contact with the conveying means, said thrusting means being actuated in connection with the operation of said loom; and cutting means for cutting the projected end portion of the weft yarn in closed proximity to a side of the fabric which side corresponds to the second side of the warp yarn array, after the projected end portion is thrust into said location, said cutting means being located between the fabric and said conveying means.

25. A weft yarn end treating device as claimed in claim 24, in which said thrusting means includes a hook member for pulling and thrusting the projected end portion of the weft yarn into said space between the first and second rollers, said hook member being movable in accordance with the operation of said shuttleless loom.

26. A weft yarn end treating device as claimed in claim 25, in which said first and second spiral grooves are so formed that the projected end portion of the weft yarn thrusted into said space is carried from a first end toward a second end of each of said first and second rollers.

27. A weft yarn end treating device as claimed in claim 25, in which said first spiral groove is formed in the same direction as that of a left hand screw, said second spiral groove is formed in the same direction as that of a right hand screw.

28. A weft yarn end treating device as claimed in claim 27, in which said first roller is provided with a first gear, and said second roller is provided with a second gear which meshes with said first gear so that the first and second rollers are rotatable in the opposite directions to each other.

29. A weft yarn end treating device as claimed in claim 28, further comprising collecting means for collecting the projected end portion of the weft yarn after cut by said cutting means, said collecting means including a movable belt which is disposed under said second roller and parallelly with said side of said woven fabric.

30. A weft yarn end treating device as claimed in claim 25, in which further comprising catching means for detachably catching the end portion of the picked weft yarn adjacent the second side of the warp yarn array, maintaining the end portion of the picked weft yarn in its tensioned state.

31. A weft yarn treating device as claimed in claim 30, in which said catching means includes sucking means for sucking therein the end portion of the picked weft yarn by the action of suction vacuum.

32. A weft yarn end treating device as claimed in claim 3, in which said sucking means includes a cylindrical tube disposed adjacent the second side of the warp yarn array and having its axis which is arranged parallelly with the weave front of the woven fabric, said cylindrical tube being fluidly connected to a suction vacuum source to generate therein a suction vacuum.

33. In a shuttleless loom having yarn inserting means located adjacent a first side of the array to warp yarns from which inserting means a weft yarn is picked into the shed of the warp yarns to weave a fabric, a weft yarn end treating device for treating an end portion of the picked weft yarn which end portion is projected from a second side of the array of the warp yarns, the second side being opposite to the first side and remote away from the yarn inserting means, said weft yarn end treating device comprising:

conveying means for conveying the projected end portion of the weft yarn in a direction generally the same as the moving direction of woven fabric, when the projected end portion is held to contact therewith, said conveying means including a belt movable in the direction substantially the same as the moving direction of the woven fabric, said belt being loop-shaped and passed on first and second pulleys which are located separate from each other, said first pulley being located adjacent said cutting means;

holding means for holding the projected end portion to contact with said conveying means, said holding means including a stationary plate member contactable with the surface of said belt, said stationary plate member being secured to the frame of said shuttleless loom and including a higher portion to which the surface of the belt is contactable, and a lower portion which is depressed below said higher portion and from which the surface of said belt is spaced apart;

thrusting means for thrusting the projected end portion of the weft yarn into a location at which the projected end portion begins to be held to contact with the conveying means, said thrusting means being actuated in connection with the operation of said loom, said thrusting means including a movable rod member swingably supported on the frame of a reed of said shuttleless loom, said movable rod member including upper and lower portions which extend generally oppositely with respect to a portion at which said movable rod member is swingably supported, and a push rod member disposed stationary relative to the frame of said shuttleless loom, said push rod member being strikable against the upper portion of said movable rod member to move the lower portion of said movable rod member so as to carry the projected end portion of the weft yarn into said location; and cutting means for cutting the projected end portion of the weft yarn in close proximity to a side of the fabric which side corresponds to the second side of the warp yarn array, after the projected end portion is thrust into said location, said cutting means being located between the fabric and said conveying means.

34. In a shuttleless loom having yarn a shed and inserting means located adjacent a first side of the array of warp yarns from which inserting means a weft yarn is picked into the shed of the warp yarns to weave a fabric, a weft yarn end treating device for treating an end portion of the picked weft yarn which end portion is projected from a second side of the array of the warp yarns, the second side being opposite to the first side and remote away from the yarn inserting means, said weft yarn end treating device comprising:

conveying means for conveying the projected end portion of the weft yarn in a direction generally the same as the moving direction of woven fabric from a portion adjacent the weave front of a woven fabric, when the projected end portion is held to contact therewith, said conveying means including a rotatable cylindrical roller formed at its cylindrical surface with a continuous spiral groove;

holding means for holding the projected end portion to contact with said conveying means;

thrusting means for thrusting the projected end portion of the weft yarn into a location at which the projected end portion begins to be held to contact with the conveying means, said thrusting means being actuated in connection with the operation of said loom; and cutting means for cutting the projected end portion of the weft yarn in close proximity to a side of the fabric which side corresponds to the second side of the warp yarn array, after the projected end portion is thrusted into said location, said cutting means being located between the fabric and said conveying means.

* * * * *